US012378975B2

(12) United States Patent
Schaupp et al.

(10) Patent No.: US 12,378,975 B2
(45) Date of Patent: Aug. 5, 2025

(54) PNEUMATIC FLUID PUMP WITH DUAL ROTATIONAL SWIRLING CLEANING ACTION

(71) Applicant: Q.E.D. Environmental Systems, Inc., Dexter, MI (US)

(72) Inventors: John F. Schaupp, Sylvania, OH (US); Joseph Lawrence Schaffer, New Hudson, MI (US); Mark T. Weinberger, Mounds View, MN (US); Daniel P. Ross, Vadnais Heights, MN (US); Brett M. Crouse, Chelsea, MI (US); Steven Richard Wells, Howell, MI (US)

(73) Assignee: Q.E.D. Environmental Systems, Inc., Dexter, MI (US)

( * ) Notice: Subject to any disclaimer, the term of this patent is extended or adjusted under 35 U.S.C. 154(b) by 313 days.

(21) Appl. No.: 17/634,121

(22) PCT Filed: Jul. 1, 2020

(86) PCT No.: PCT/US2020/040524
§ 371 (c)(1),
(2) Date: Feb. 9, 2022

(87) PCT Pub. No.: WO2021/034411
PCT Pub. Date: Feb. 25, 2021

(65) Prior Publication Data

US 2022/0290694 A1 Sep. 15, 2022

Related U.S. Application Data

(60) Provisional application No. 62/900,879, filed on Sep. 16, 2019, provisional application No. 62/888,730, filed on Aug. 19, 2019.

(51) Int. Cl.
*F04F 1/20* (2006.01)
*F04D 13/04* (2006.01)
*F04F 1/18* (2006.01)

(52) U.S. Cl.
CPC ..... *F04F 1/20* (2013.01); *F04D 13/04* (2013.01); *F04F 1/18* (2013.01)

(58) Field of Classification Search
CPC ..... F04F 1/06; F04F 1/08; F04F 1/18; F04F 1/20; F04D 13/04; E21B 43/121–123
(Continued)

(56) References Cited

U.S. PATENT DOCUMENTS 860,523 A 7/1907 Canales
1,144,342 A * 6/1915 Andrews ..... F04F 1/18 417/108
(Continued)

FOREIGN PATENT DOCUMENTS

CN 1173588 A 2/1998
CN 1503879 A 6/2004
(Continued)

OTHER PUBLICATIONS

International Preliminary Report on Patentability for PCT Application No. PCT/US2020/040524, Dated Feb. 17, 2022, pp. 11.
(Continued)

*Primary Examiner* — Alexander B Comley
(74) *Attorney, Agent, or Firm* — Kinney & Lange, P.A.

(57) ABSTRACT

The present disclosure relates to a fluid pump which has a pump casing, a top cap securable to an upper end of the pump casing and having an air intake port and a fluid discharge port. A fluid discharge tube extends to adjacent a lower end of the pump casing. A one-way check valve is disposed adjacent the lower end of the pump and forms a one-way path to admit fluid into the pump casing during a
(Continued)

fill cycle of operation of the pump. A one-way check valve at the discharge port allows fluid to escape during a discharge cycle. An auger element is disposed inside the pump casing for causing a swirling, rotational fluid flow during a fluid eject cycle, in response to a jet of compressed air released into the pump casing, in which fluid having collected within the pump casing is forced by the jet of compressed air into and up through the discharge tube, and out from the pump casing.

20 Claims, 13 Drawing Sheets

(58) Field of Classification Search
USPC ..... 417/194, 108–117
See application file for complete search history.

(56) References Cited

U.S. PATENT DOCUMENTS 1,244,631 A * 10/1917 Mitchell ..... E21B 43/123 417/109
2,025,644 A * 12/1935 Campbell ..... F04F 1/18 417/151
3,797,968 A * 3/1974 Elfarr ..... F04F 1/02 417/145
3,873,238 A * 3/1975 Elfarr ..... E21B 43/12 417/54
3,887,342 A * 6/1975 Bunnelle ..... B01D 19/0057 417/313
5,314,018 A * 5/1994 Cobb ..... B01D 21/267 166/105.1
5,593,292 A * 1/1997 Ivey ..... F04B 53/101 137/533.15
5,810,081 A * 9/1998 Cobb ..... E21B 17/00 166/105.3
6,048,175 A * 4/2000 Corlew ..... F04F 1/08 417/139
6,368,068 B1 * 4/2002 Corlew ..... E21B 47/008 96/214
8,286,951 B2 * 10/2012 Dart ..... B01F 23/232311 261/93
2005/0039813 A1 * 2/2005 Dougherty ..... E21B 43/121 138/178
2005/0236324 A1 * 10/2005 Mildren ..... B04C 5/08 210/512.1
2006/0083646 A1 4/2006 Ford
2008/0060712 A1 * 3/2008 Gluzman ..... B01F 25/43151 138/42
2009/0065431 A1 * 3/2009 Bakke ..... B01D 19/0094 210/512.1
2009/0301710 A1 * 12/2009 Clem ..... E21B 43/045 166/242.1
2009/0308472 A1 * 12/2009 Harman ..... B01F 25/43141 137/808
2012/0273278 A1 * 11/2012 Zhu ..... E21B 27/00 175/206
2014/0127065 A1 * 5/2014 Hansen ..... F04B 49/04 417/555.2
2014/0356194 A1 * 12/2014 Ahmed ..... F04F 1/18 417/65
2016/0090995 A1 * 3/2016 Yamada ..... F25B 41/00 417/194
2016/0356134 A1 * 12/2016 Ramirez ..... F04F 1/08

FOREIGN PATENT DOCUMENTS

CN 1602387 A 3/2005
CN 102345791 B * 3/2013
CN 106030115 A 10/2016
CN 106969655 A * 7/2017 ..... F04F 1/18
CN 107906086 A * 4/2018 ..... F15D 1/0015
CN 108049845 A * 5/2018 ..... E21B 43/121
CN 108474246 A 8/2018
KR 20160147661 A 12/2016
RU 2632607 C1 10/2017

OTHER PUBLICATIONS

Extended European Search Report for EP Application No. 20854235.7, Dated Jun. 6, 2023, pp. 8.
International Search Report and Written Opinion for PCT Application No. PCT/US2020/040524, Dated Oct. 7, 2020, pp. 12.
First Chinese Office Action for CN Application No. 202080058048.1, Dated Jun. 14, 2024, pp. 20.

* cited by examiner

PNEUMATIC FLUID PUMP WITH DUAL ROTATIONAL SWIRLING CLEANING ACTION

CROSS-REFERENCE TO RELATED APPLICATIONS

This application claims the benefit of U.S. Provisional Application No. 62/900,879, filed on Sep. 16, 2019, and U.S. Provisional Application No. 62/888,730, filed on Aug. 19, 2019. The entire disclosures of each of the above applications are incorporated herein by reference.

FIELD

The present disclosure relates to pneumatically actuated fluid pumps, and more particularly to a fluid pump incorporating a swirl inducing element for introducing a counter rotational swirling action during fill and discharge cycles of the pump to help clean interior surfaces and interior components of the pump.

BACKGROUND

The statements in this section merely provide background information related to the present disclosure and may not constitute prior art.

Pneumatic fluid pumps are used in a wide variety of applications. One particularly important application is at landfills to pump water and water mixed with leachate from landfill wells. This application presents particularly challenging issues with keeping the internal components of the pump clean. The contaminated fluids that need to be pumped can quickly cause fouling of the pump, and particularly the movable internal components of the pump such as an internal float, movable linkage elements and other components. Cleaning of such pneumatically operated pumps can be time consuming and costly.

Accordingly, there is a strong interest in any improvements and features which help to prolong the interval between cleanings of a pneumatically driven pump and which contribute to more reliable pump operation.

SUMMARY

This section provides a general summary of the disclosure, and is not a comprehensive disclosure of its full scope or all of its features.

In one aspect the present disclosure relates a fluid pump. The fluid pump may comprise a pump casing, a top cap and a fluid discharge tube. The top cap may be securable to an upper end of the pump casing and may have an air intake port and a fluid discharge port. The fluid discharge tube extends to adjacent a lower end of the pump casing. A one-way check valve may be included which is adjacent the lower end of the pump, and which forms a one-way path to admit fluid into the pump casing during a fill cycle of operation of the pump. An auger element may be included which is disposed inside the pump casing. The auger element causes a swirling, rotational fluid flow during a fluid fill or eject cycle in response to a jet of compressed air released into the pump casing. Fluid having collected within the pump casing is forced by the jet of compressed air into and up through the discharge tube, and out from the pump casing.

In another aspect the present disclosure relates to a fluid pump. The fluid pump may comprise a pump outer casing and a top cap securable to an upper end of the pump outer casing and having an air intake port and a fluid discharge port. A fluid discharge tube may be included which extends to a point adjacent a lower end of the pump outer casing. A one-way check valve is disposed in the pump outer casing adjacent the lower end of the pump, and forms a one-way path to admit fluid into the pump outer casing during a fill cycle of operation of the pump. An auger subassembly is included which is disposed inside the pump outer casing. The auger subassembly causes a first swirling, rotational fluid flow during a fluid fill cycle of operation of the pump, where fluid is being admitted into the pump outer casing through the one-way check valve. The auger subassembly also causes a second swirling, rotational fluid flow during a fluid eject cycle of operation of the pump, in response to the jet of pressurized air released into the pump outer casing. This causes fluid having collected within the pump outer casing to be forced by the jet of pressurized air into and up through the discharge tube, and out from the pump outer casing. The auger subassembly forms a unitary subassembly that may be slid over the fluid discharge tube or integrated with the pump's casing and secured thereto during assembly of the pump.

In still another aspect, the present disclosure relates to a method for pumping fluid using a pneumatically operated fluid pump. The method may comprise admitting fluid into a pump outer casing through a one-way check valve located at a lower end of the pump casing. During the admitting of fluid into the pump outer casing, the method involves imparting a swirling, rotational flow to the fluid in a first rotational direction. When the pump outer casing is full with fluid, the method involves admitting a jet of pressurized air into the pump outer casing, and using the jet of pressurized air to cause the one-way check valve to close the lower end of the pump. The method further includes using the jet of pressurized air in connection with an auger element to also cause a swirling, rotational fluid flow in a second rotational direction opposite to the first rotational direction, as the fluid within the pump outer casing is forced into an up through a fluid discharge tube.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

Figure 15:
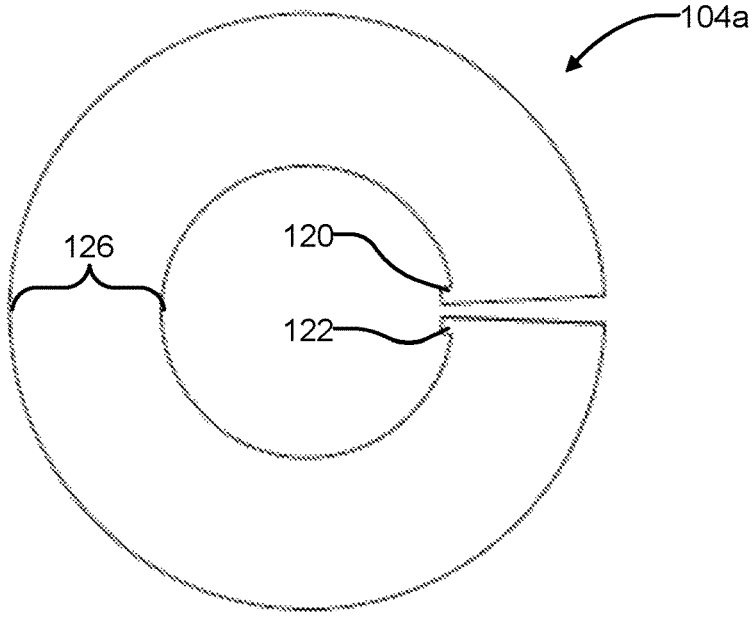
FIG. 15 shows the auger section of FIG. 14 after having been cut from sheet metal.
Figure 17:
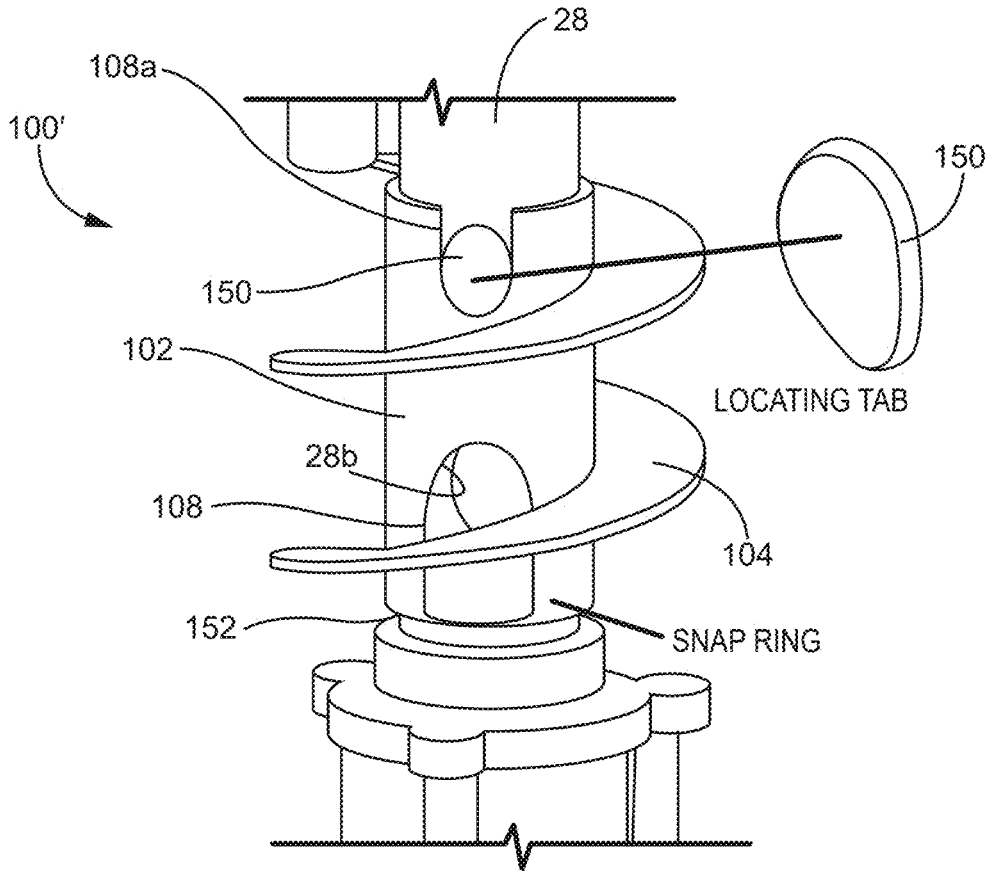
Figures 18, 19, 20:
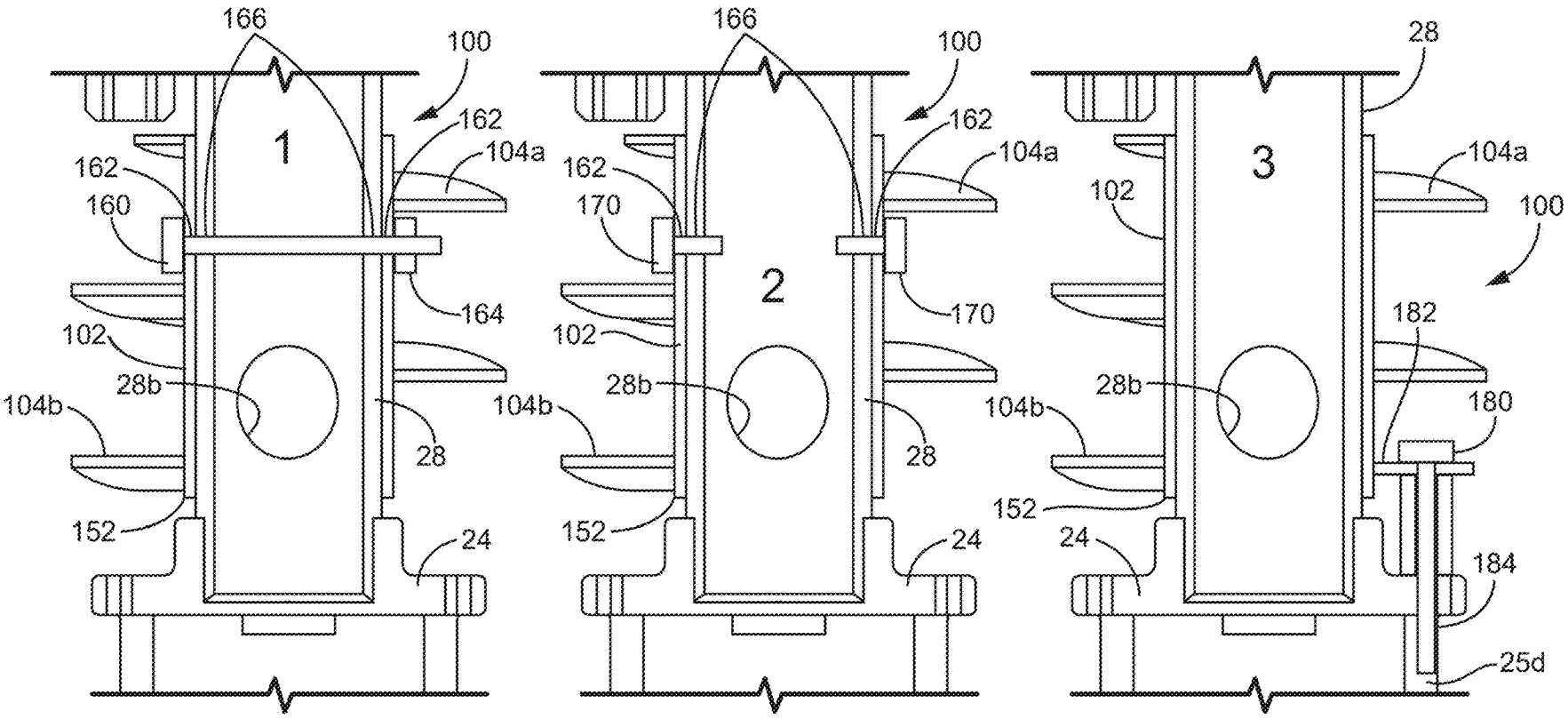

Further 16 is a side view in accordance with section line 16-16 in FIG. 15 showing a side view of the auger section after having been formed in its final shape;

FIG. 17 is a perspective view of another implement where the auger element is aligned on the discharge tube using a permanently installed locating tab, to thus ensure alignment of the lower inverted U-shaped notch in the auger element body portion with the fluid entry openings in the lower end of the fluid discharge tube;

FIG. 18 is a simplified side cross sectional view of the auger subsystem being secured to the fluid discharge tube using a through bolt and nut (or through pin) which extends fully through the cross sectional width of the barrel portion;

FIG. 19 shows another method of attachment of the auger subassembly to the fluid discharge tube using one or more rivets; and FIG. 20 shows still another method of attachment of the auger subassembly to the fluid discharge tube using a threaded bolt which is arranged parallel to the fluid discharge tube, and which engages a laterally extending flange of the barrel portion.

DETAILED DESCRIPTION

Example embodiments will now be described more fully with reference to the accompanying drawings.

Figure 1:
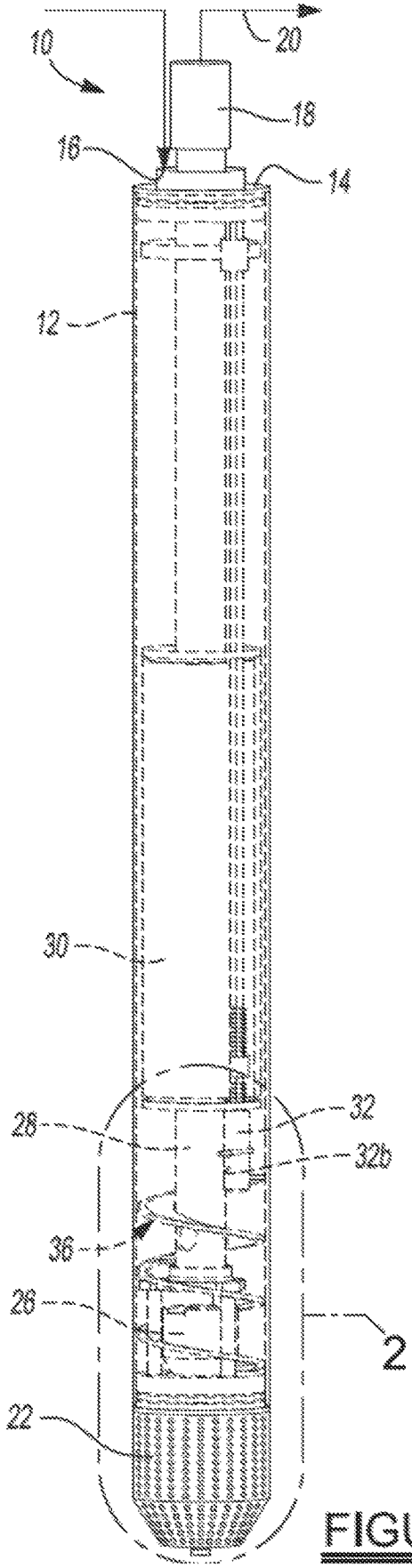
FIG. 1 is an elevational side view of one embodiment of a pneumatic pump in accordance with the present disclosure.
Figure 2:
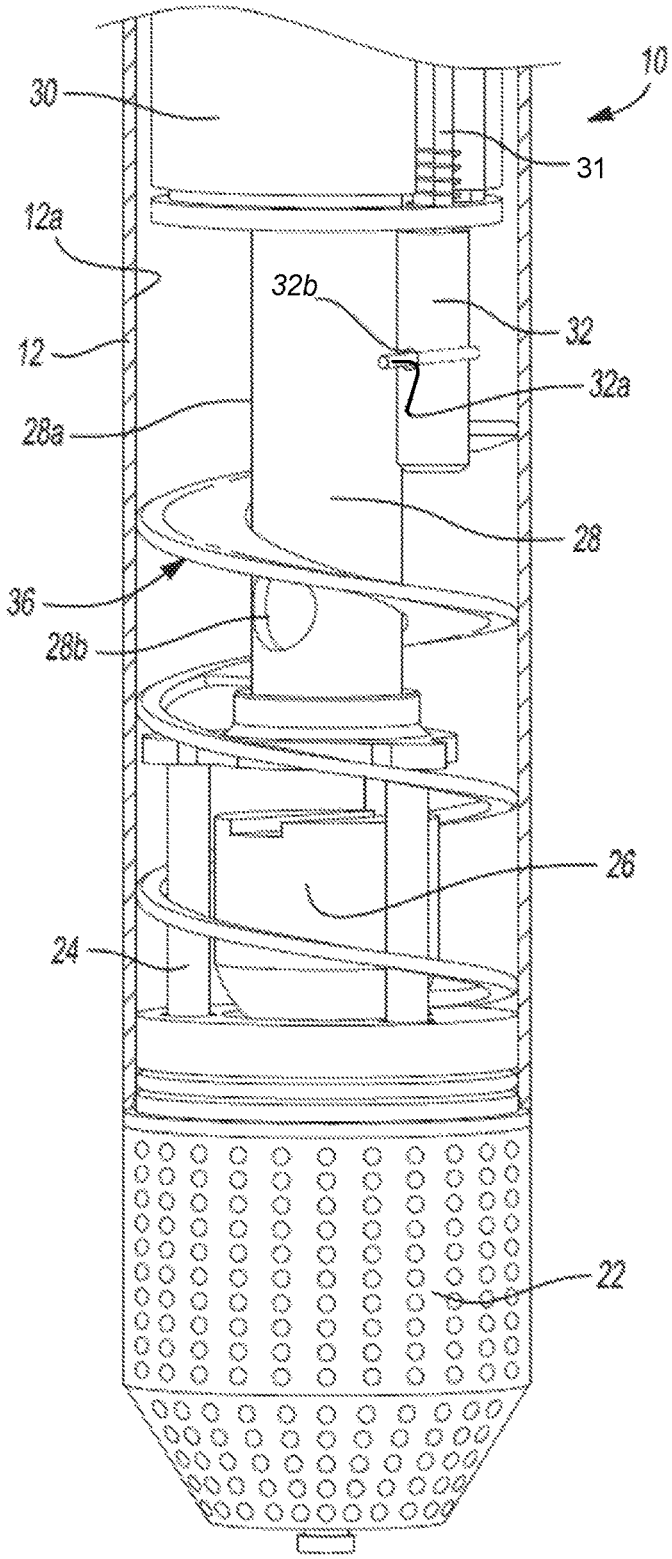
FIG. 2 is an enlarged section view of a portion of the pump of FIG. 1 taken from circled area 2 in FIG. 1.
Figure 4:
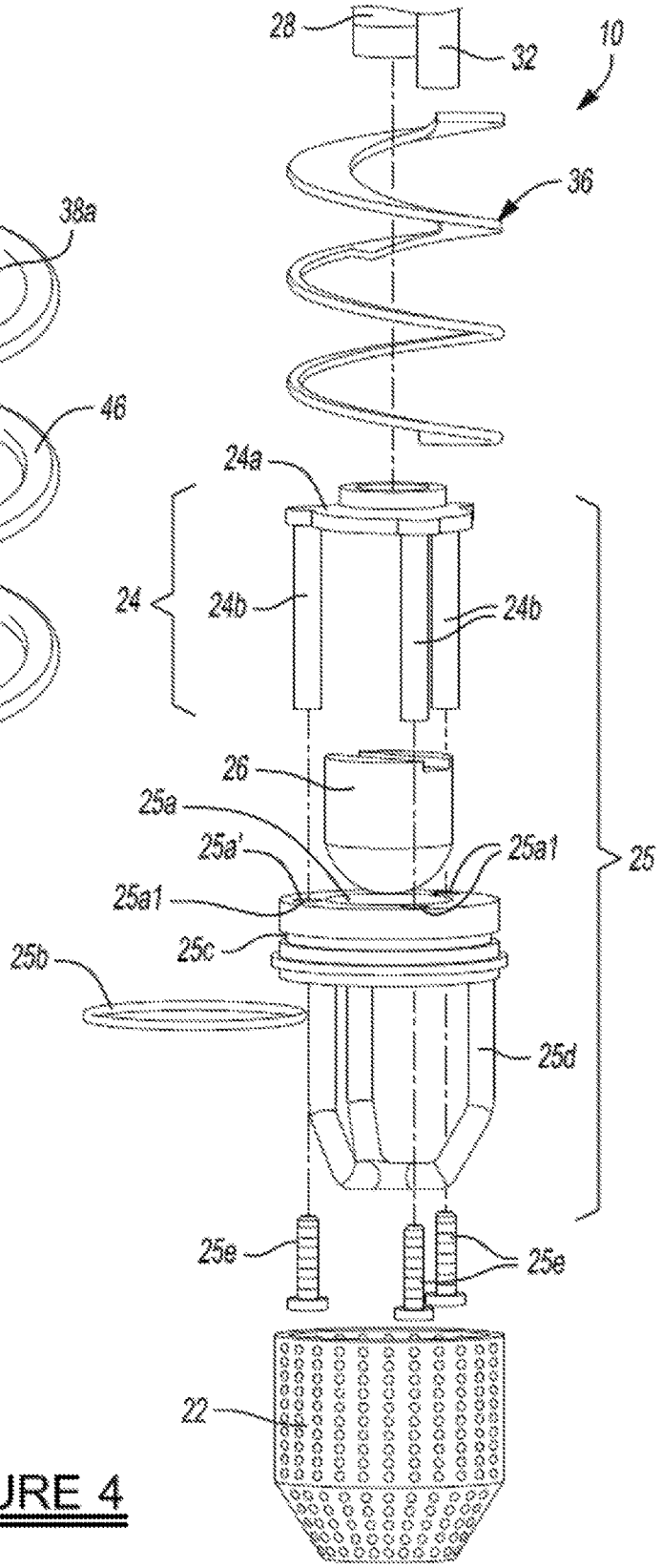
FIG. 4 is an exploded perspective view of major components of the pump of FIG. 1.

Referring to FIGS. 1, 2 and 4 there is shown a pneumatic pump 10 (hereinafter simply "pump" 10) in accordance with the present disclosure. The pump 10 is especially well suited for pumping contaminated liquids that are likely to cause contaminants and sludge buildup in the pump, such as in landfill well applications, although it will be appreciated that the pump 10 may be used in any application where it is important to maintain the inner workings of the pump clean and free of a buildup of contaminants.

As shown in FIGS. 1 and 4, the pump 10 includes a pump casing 12, a pump cap 14 having an air inlet 16 for receiving compressed air from a compressed air source, and a coupling 18, which forms a one-way check valve, for connecting to a fluid carrying discharge conduit 20. A lower end of the pump casing 12 includes a screen 22 secured thereto, and a one-way check valve assembly 25. The one-way check valve assembly 25 is made up of a three-legged spider assembly 24 having an upper wall portion 24*a* and sleeves 24*b*, a poppet element 26 captured within the three-legged spider assembly, a valve seat member 25*a*' having a valve seat 25*a*, an O-ring 25*b* which fits in a circumferential groove 25*c* on the valve seat perimeter, and a three legged frame 25*d* over which the screen 22 fits. A plurality of threaded fasteners 25*e* may be used to secure the legs of the three-legged spider assembly 24 to the valve seat member 25*a*' via holes 25*a*1 in the valve seat member 25*a*'. The one-way check valve assembly 25 allows fluid flow in one direction only (i.e., into the pump casing 12 from outside the pump 10).

With further reference to FIGS. 1, 2 and 4, a discharge tube 28 is in fluid communication with the coupling 18 to allow the ejection of fluid up through the two oppositely arranged openings 28*b* (only one being visible in the figure) in the discharge tube 28 and into the fluid carrying discharge conduit 20. A float 30 is disposed around the discharge tube 28. A spring cup 32 is secured at an end of a control rod 31 via a pin 32*a*, which extends through opening 32*b*, and enables a spring 31*a* to be held on to the end of the control rod 31. The control rod 31 is associated with a valve (not shown) that helps to control the admission of air into the pump casing 12 through the air inlet 16.

The float moves up and down along the outer surface of the discharge tube in response to changing fluid levels in the pump casing 12. The float 30 actuates a conventional air admission control valve assembly (not visible in the Figure) located near an upper end of the pump casing 12 which opens an air admission control valve when the float reaches a predetermined upper limit of travel, indicating the pump is full with liquid and that an ejection cycle needs to be commenced. The compressed air is directed as a jet through the air inlet 16 towards a lower end of the pump casing 12. The air forces liquid which has collected in the pump casing 12 into the discharge tube 28 through the ports 28*a*. As the float 30 descends to a predetermined lower limit as fluid is pumped up through the discharge tube 28, the air admission valve is closed, a vent valve (not shown) is opened to vent the pump casing 12, and the fill cycle repeats itself. The components 12-32 are well known components often used with pneumatic, auto-cycling pumps, and as such no further description will be provided. The assignee of the present disclosure, QED, Inc., is a leader in the manufacture and sale of pneumatically actuated auto-cycling pumps such as described above.

Figure 3A:
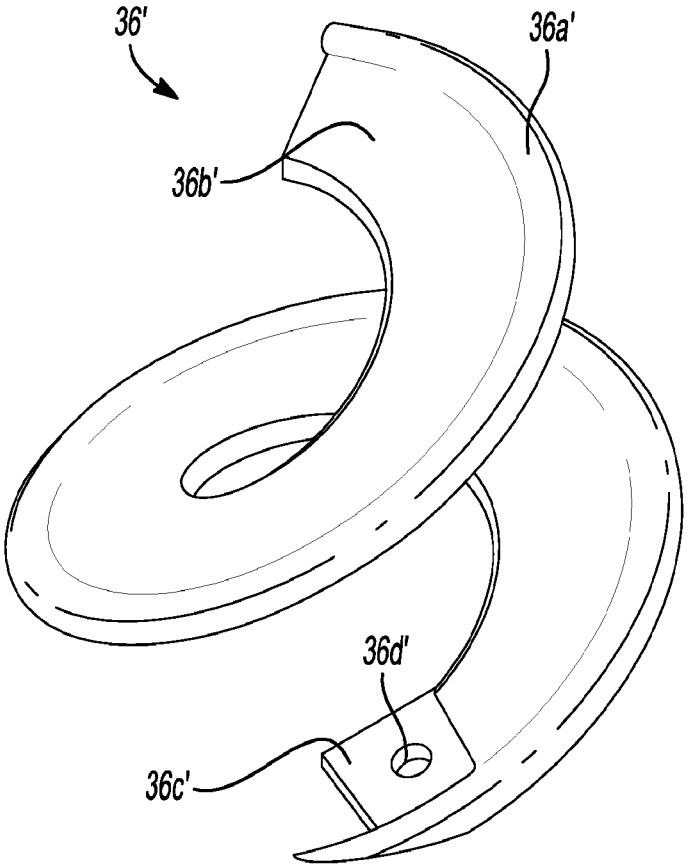
FIG. 3*a* shows another embodiment of the auger element illustrating one type of construction that makes use of a helical wife and an attached planar section.
Figure 3:
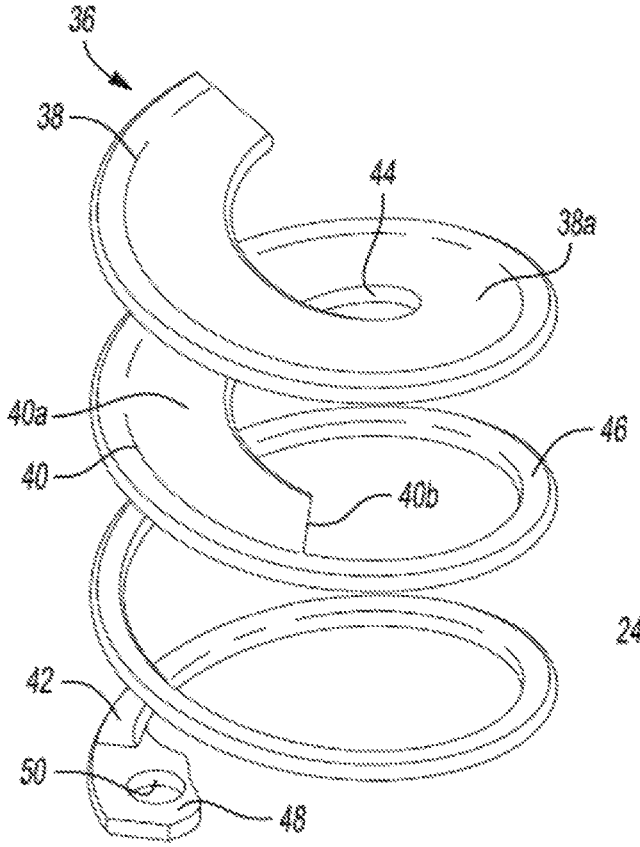
FIG. 3 is an exploded perspective view of various components of the pump of FIG. 1.

The pump 10 of the present disclosure differs from conventional pneumatic, auto-cycling pumps through the incorporation of a swirling flow inducing auger element 36, best seen in FIGS. 2-4. The auger element 36 forms a helical shaped component having an outer diameter just slightly smaller than an inner diameter of the pump casing 12 so that it can be easily slid into the pump casing during initial assembly of the pump 10. The auger element 36 may be made from any suitable material, for example high strength plastic such as PPS, or a metal material, for example 316 stainless steel or aluminum. The auger geometry could also be integrated with pump casing 12.

With specific reference to FIGS. 2 and 3, the auger element 36 includes an upper end 38, a mid-portion 40 and a lower end 42. At the upper end 38 the auger element 36 forms a central opening 44 having a diameter just slightly larger than the outer diameter of the discharge tube 28, such that the discharge tube can extend at least partially through the auger element. The upper end 38 has a upper radial wall section 38*a* having a radial length that substantially extends to fill the space between an outer surface 28*a* of the discharge tube 28 and an inner surface 12*a* of the pump casing 12. A mid radial wall section 40*a* of the mid portion 40 is substantially similar, or the same, as that of the upper radial wall section 38*a*, but includes an angular edge 40*b*. The angular edge 40*b* provides clearance for the auger element 36 to extend around the spider assembly 24 when assembled into the pump casing 12. The mid radial wall section 40*a* narrows down considerably to a lower radial wall section 46 that extends in a helical path to a distal end 48 of the auger element 36. The distal end 48 in this example includes a hole 50 to allow passage of one of the legs of the spider assembly 24 to pass through when the auger element 36 is installed in the pump casing 12. The upper radial wall section 38*a*, the mid radial wall section 40*a* and the lower radial wall section 46 form a continuous radial helical wall section. The wall sections 38*a*, 40*a* and 46 cooperatively from an open at a radial center of the auger element 36 such that the discharge tube 28 is centered within the auger element.

The overall length of the auger element 36 may vary to meet the needs of a specific pump application. However, it is anticipated that in most embodiments the auger element 36 will have a length sufficient to extend from the upper wall section 24*a* of the spider assembly 24 up and over at least a portion of the discharge tube 28. The amount of float 30 travel will have a large bearing on the permissible overall length of the auger element 36, as the auger element should not interfere with descending elevational movement of the float.

It will be appreciated that in some applications it may be desirable to form the auger element 36 in two or more distinct sections to fit together adjacent one another, and in some instances, this may even further simplify assembly of the auger element 36 into the pump casing 12. This may be particularly so if the auger element 36 is being retrofit into an existing pump. Both a single component and multi-component embodiment of the auger element 36 is contemplated by the present disclosure. Furthermore, the auger element 36 may be formed from one, two or more helical wires 36*a*' with an attached planar-like section 36*b*', as shown for example in FIG. 3*a* by the auger element 36'. In this example the auger element 36*a*' may also include a separately formed plate-like element 36*c*' at a lower end with a suitable sized hole 36*d* to enable easy attachment to one of the three legs of the three legged spider assembly 24. Still further, the hole 36*d* could instead by formed like a clip that enables it to be slid over one of the three legs of the three legged spider assembly 24. Still further, the auger element 36 may be formed (e.g., molded) as a single piece component from a suitable strong plastic, or formed as a single piece component from metal (e.g., stainless steel). As such, the auger element 36 or 36' is not limited to any one particular form of construction or any single material.

Once installed in the pump casing 12, the distal end 48 of the auger element 36 may rest on, or be secured in any suitable manner, to the flat upper wall section 24*a* of the spider assembly 24, while the upper end of the auger element 36 rests freely, or alternatively engages a threaded feature on the upper wall portion 24*a* of the three legged spider assembly 24, or a feature molded on, or otherwise secured to, the exterior surface 28*a* of the discharge tube 28. Such a feature that enables attachment to the upper wall portion 24*a* may be formed on the upper wall portion 24*a* itself, or the attachment feature may be formed on the upper radial wall section 38*a* near the upper end of the auger element 36. Still further, the upper radial wall section 38*a* could be threaded so that a separate fastener can be used to secure it to the upper wall portion 24*a* or possibly to a mid-point of the discharge tube 28. In all of the above configurations, the upper end of the auger element 36 will be captured and held stationary within the pump casing 12. Thus, the auger element 36 can be assembled into, and disassembled from, the pump 10 without necessitating any significant re-design of the major pump components (e.g., float 30, spider assembly 24, discharge tube 28, etc.).

Figure 5:
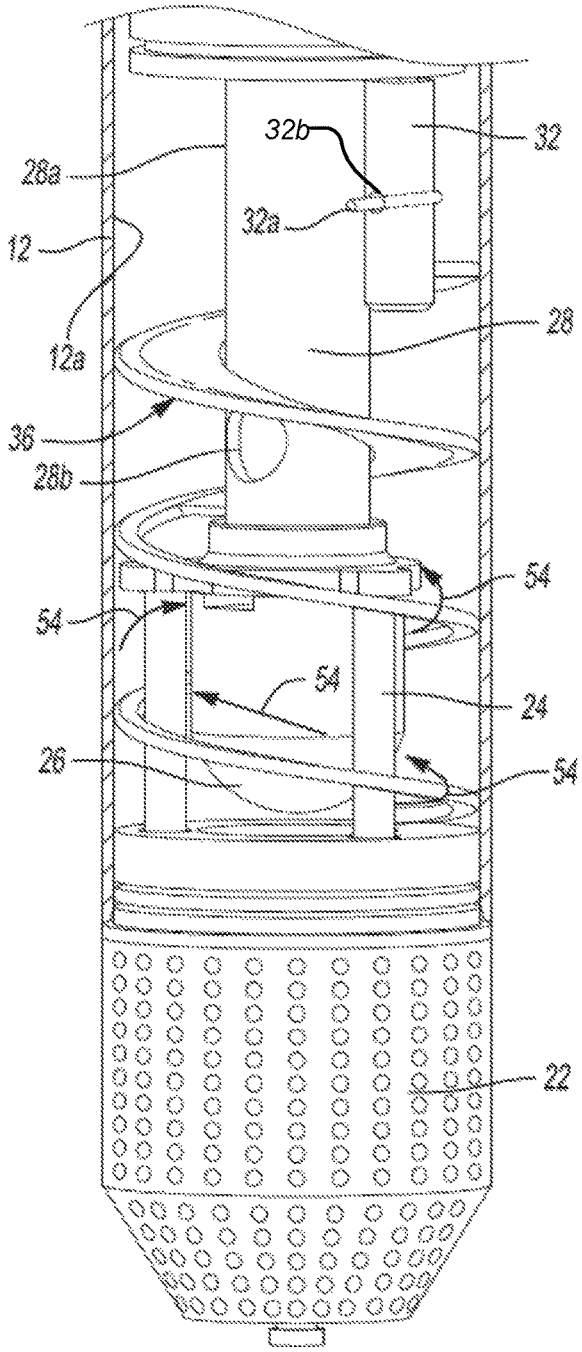
FIG. 5 is a side partial cross sectional view of the pump of FIG. 1 during a fill cycle, where fluid flows into a pump casing at a lower inlet and an auger element causes a rotational swirling flow of the fluid in a first rotational direction.
Figure 6:
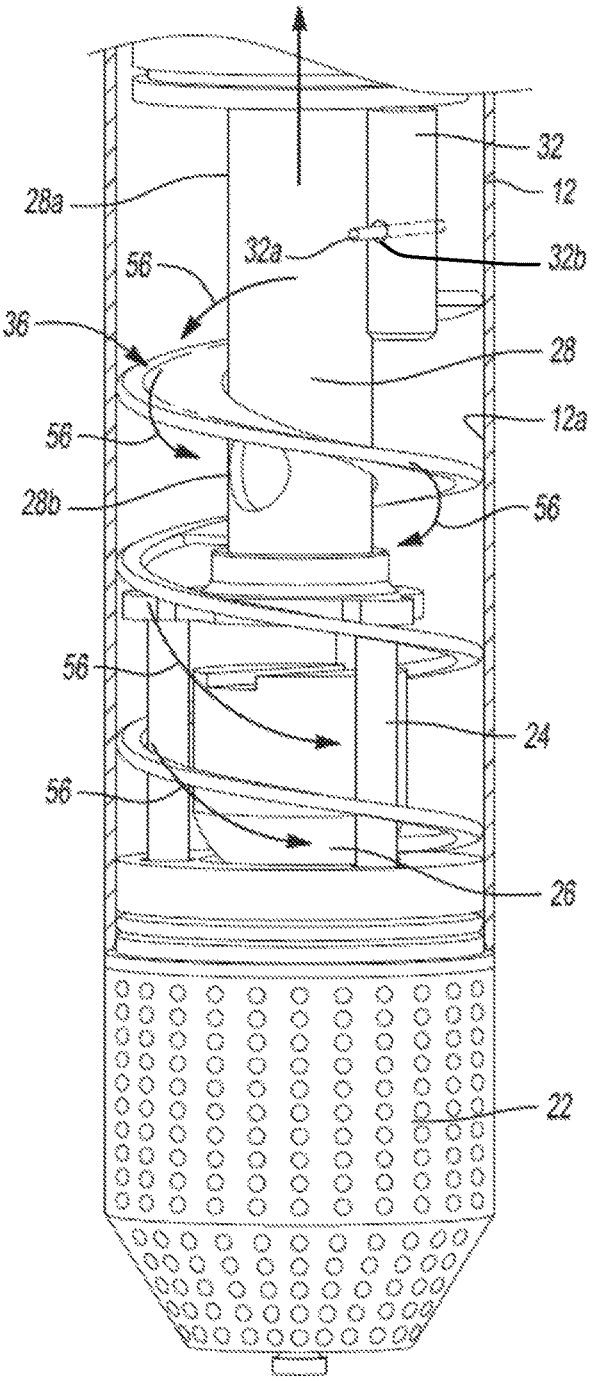
FIG. 6 is a side partial cross sectional view of the pump of FIG. 4 but during a fluid ejection cycle, where the auger element induces a strong swirling motion to fluid as the fluid is forced into a lower end of a discharge tube.

Referring to FIGS. 5 and 6, the operation of the pump 10 and particularly the operation of the auger element 36 will be described. The auger element 36 provides a dual rotational fluid flow feature in which fluid flowing past the poppet element 26 and entering the pump casing 12 is caused to flow in a first swirling, rotational direction, indicated by arrows 54, as the liquid fills the lower end of the pump casing 12. This helps to clean the poppet element 26, the valve seat 25*a*, and the structure of the spider assembly 24, as well as the inside wall 12*a* of the pump casing 12 to the highest point which the fluid (e.g., water) reaches inside the pump casing 12*a*. The float 30 is then cleaned all the way up to the top of the waterline of buoyancy on the float.

When the liquid entering the pump casing 12 fills to a predetermined upper level, the air control valve (not shown) admits pressurized air into the pump housing 12 through air inlet 16 to begin a fluid eject cycle. This induces a strong swirling fluid flow inside the pump casing 12 in a second rotational direction, denoted by arrows 56 in FIG. 6. The helical-like swirling flow 56 is in the opposite rotational direction as the swirling flow 54 during the fill cycle. The swirling flow 56 is forced into opposing discharge ports 28*a* (only one being visible in FIGS. 5 and 6) at a lower end of the discharge tube 28, and then up through the discharge tube 28 into the fluid discharge conduit 20. The strong swirling flow 56 provides a significant cleaning effect to help break loose contaminant particles that may be sticking to the outer surface of the float 30, the outer surface 28*a* of the discharge tube 28, as well as on the inside surface 12*a* of the pump casing 12, on portions of the spider assembly 24 and the poppet element 26, and even on the auger element 36 itself, during the fluid eject cycle.

A particular advantage provided by auger element 36 is the abrupt transition in flow direction that occurs within the pump casing 12 when switching from the fluid fill cycle to the fluid eject cycle. This abrupt transition in flow creates a strong turbulent flow action inside the pump casing 12. The flow direction changes from the swirling flow 54 to swirling flow 56 within milliseconds, which creates an especially strong, momentary, turbulent "burst" of fluid as the fluid flow abruptly changes direction by 180 degrees. This abrupt "burst" of turbulent flow provides an especially strong cleaning action on the exterior surface of the float 30, as well as on the inside wall 12*a* of the pump casing 12, on the auger element 36 itself, and even on at least a portion of the float 30, without detracting in any way from carrying out the fluid eject cycle of operation of the pump 10 and discharge tube 28.

Figure 8:
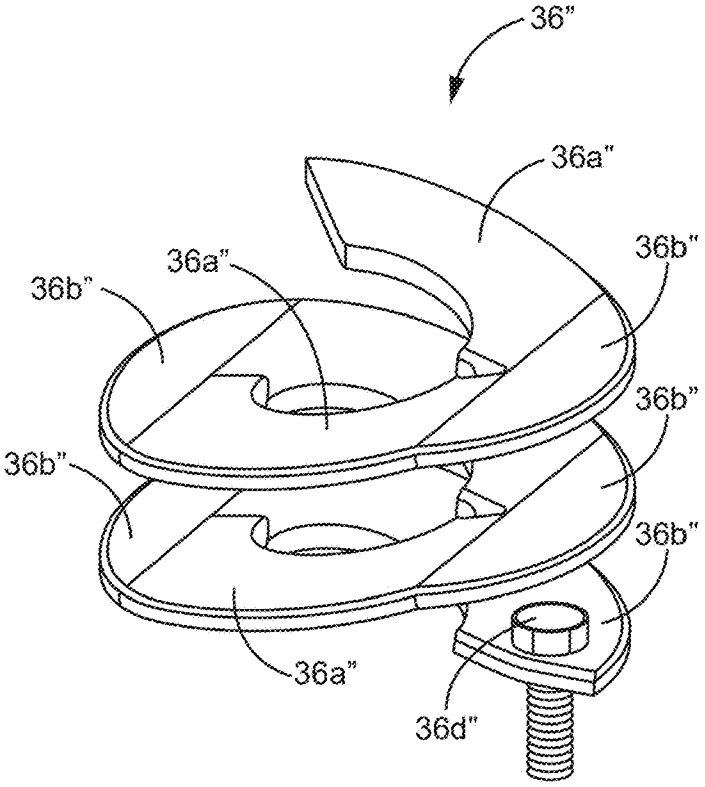
FIG. 8 is a perspective view of the auger element of FIG. 7.
Figure 7:
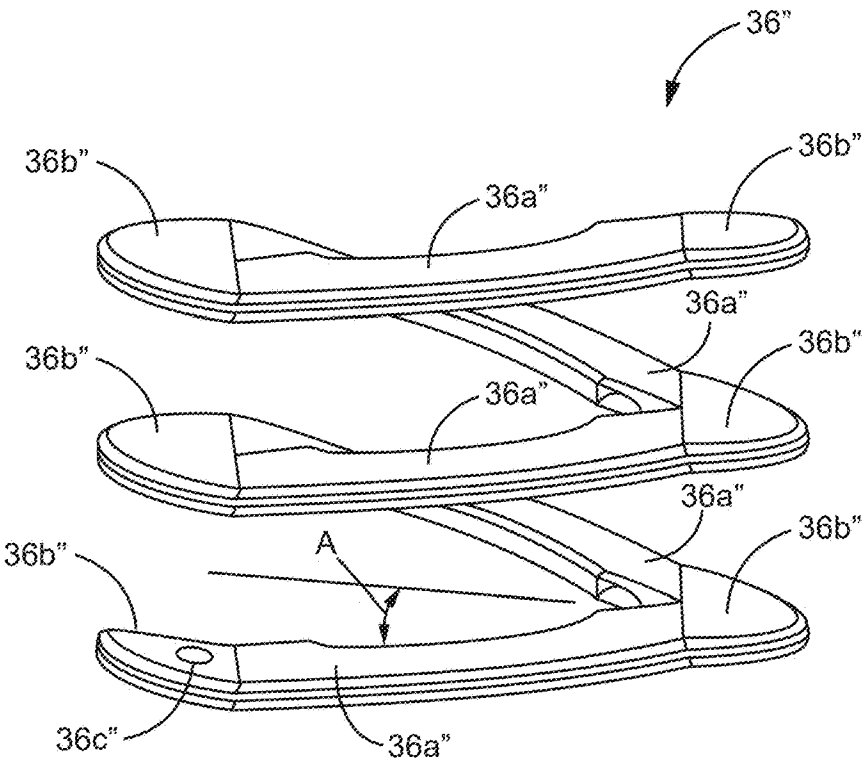
FIG. 7 is a side view of another embodiment of an auger element in accordance with the present disclosure.
Figure 9:
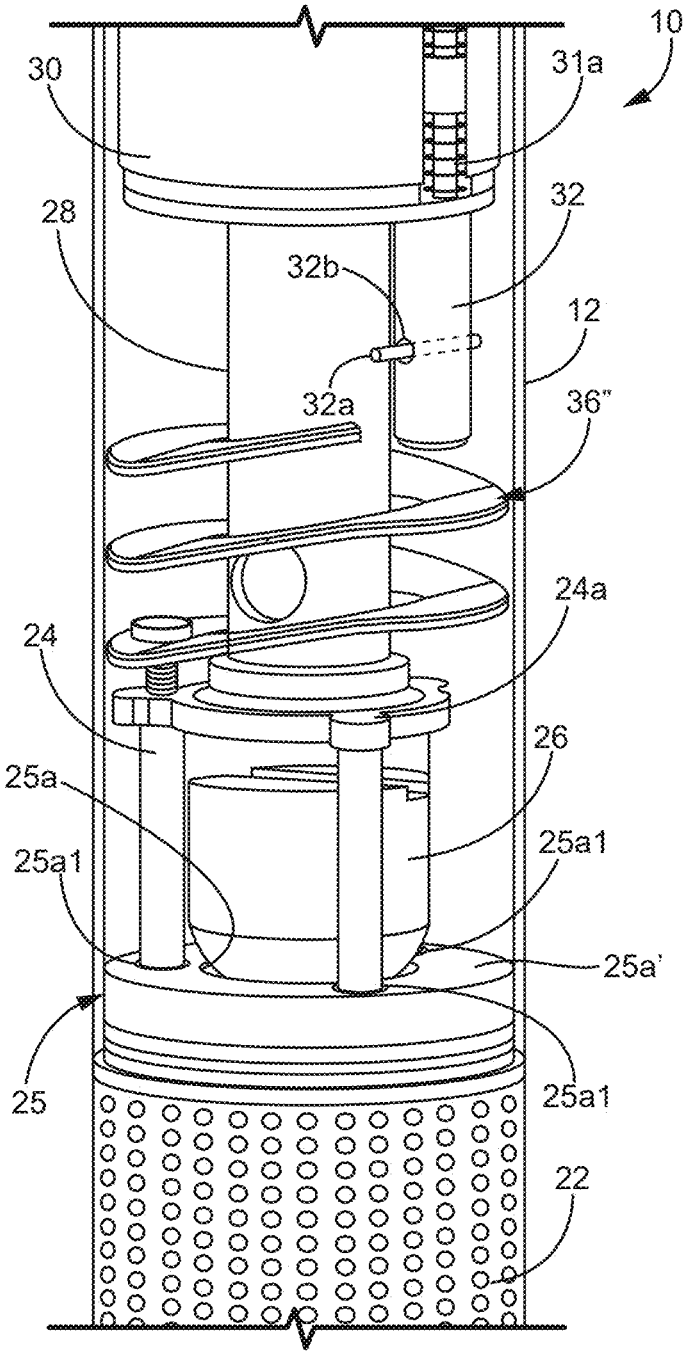
FIG. 9 is a simplified side perspective view of the auger element of FIG. 7 installed in the pump casing.

Referring to FIGS. 7-9, an auger element 36" in accordance with another embodiment of the present disclosure is presented. The auger element 36" in this example includes offset step or ramp portions 36*a*" which are interconnected by generally flat portions 36*b*" to form a continuous, circumferential, helical, flow swirl inducing element. One of the ramp portions 36*b*" may include a hole 36*c*" to enable a threaded bolt to be used to secure one end of the auger element 36" fixedly within the pump casing 12.

The auger element 36" provides a significant advantage in that with the opposing arrangement of the offset flat portions 36*a*", the auger element 36" can be injection molded using a conventional two part injection molding tool. Another advantage of the auger element 36" is that the ramp portions 36*a*" are substantially shallower in angle than the auger element 36 or the auger element 36'. This enables a great number of turns to be implemented with the auger element 36" in any give longitudinal space. With the auger element 36", the angle of each ramp portion 36*a*" relative to a horizontal line A as shown in FIG. 7, is about 3 degrees–45 degrees, and more preferably about 9 degrees–15 degrees. Thus, even in pump applications where the auger element 36" has limited longitudinal space to impart a strong swirling motion, the additional turns and reduced spacing between the ramp portions 36*a*" significantly helps to impart a strong swirling motion to the fluid during both the discharge and intake cycles.

FIG. 8 shows the auger element 36" but where the upper end is truncated to remove the uppermost flat portion 36*b*. FIG. 7 also shows a threaded fastener 36*d*" which may be used to secure the auger element 36" to the upper surface 24*a* of the three-legged spider assembly 24 when the three-legged spider assembly is fully assembled to the valve seat member 25*a*' of the one-way valve assembly 25. FIG. 9 shows the auger element 36" fully assembled into the pump 10 by attachment to the upper wall portion 24*a* of the three-legged spider assembly 24. Alternatively, the auger element 36" could just as readily be attached to the valve seat member 25*a*', provided sufficient clearance exists between the sleeves 24*b* of the three-legged spider assembly 24 and the interior wall of the pump casing 12. Attachment to valve seat member 25*a*' enables an overall longer length for the auger element 36" to be implemented, which may even further improve the strength of the swirling flow that the auger element induces during one or both of the fluid intake and fluid eject cycles.

The auger element 36" may be made from a suitable high strength plastic. Alternatively, the auger element 36" may be made from stainless steel or any other suitably durable material. The auger element 36" may be constructed in to pieces which are adapted to be positioned adjacent to one another in an interlocking manner, or it may be manufactured as a single piece component as shown in FIGS. 7-9. Both constructions are contemplated by the present disclosure.

Figure 10:
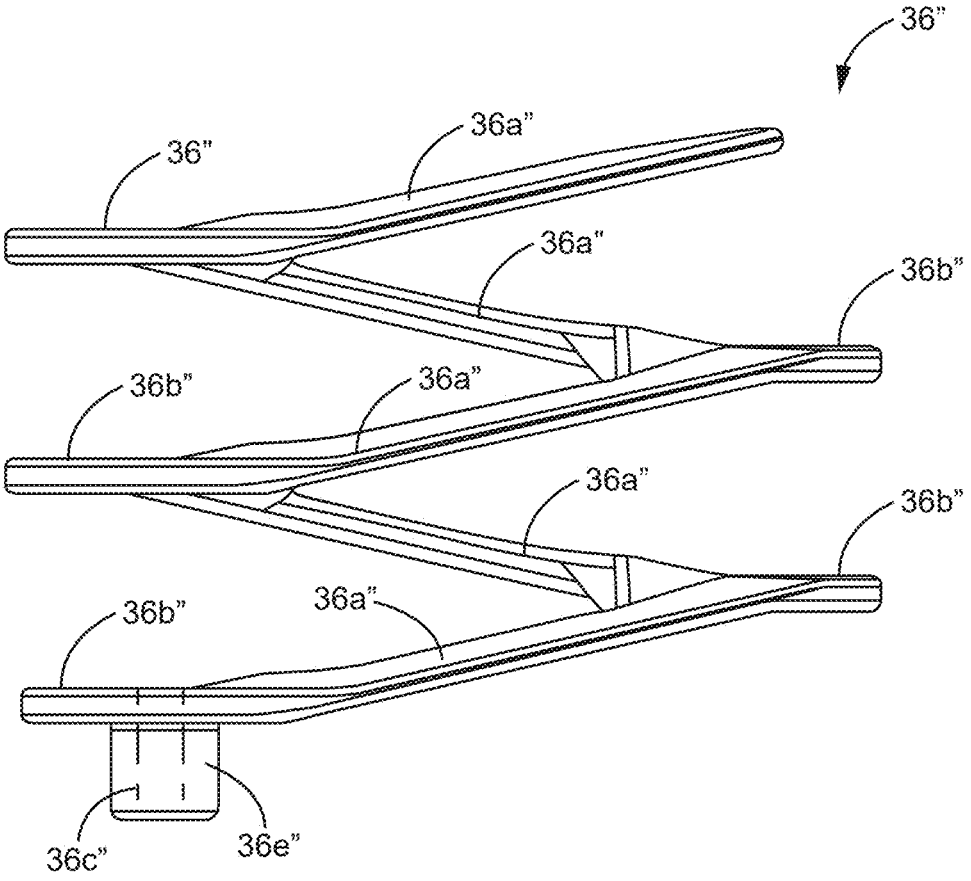
FIG. 10 is a side elevation view of the auger element of FIG. 8 but incorporating a spacer element to set an offset distance for the auger element when installing the auger element.

FIG. 10 shows the auger element 36" in another embodiment including a spacer element 36*e*". The spacer element 36*e*" sets an offset distance from the surface (either upper surface 34*a* or the valve seat member 25*a*) to which the auger element 36" is attached, and may further help to prevent breakage of the auger element during installation.

Figure 11:
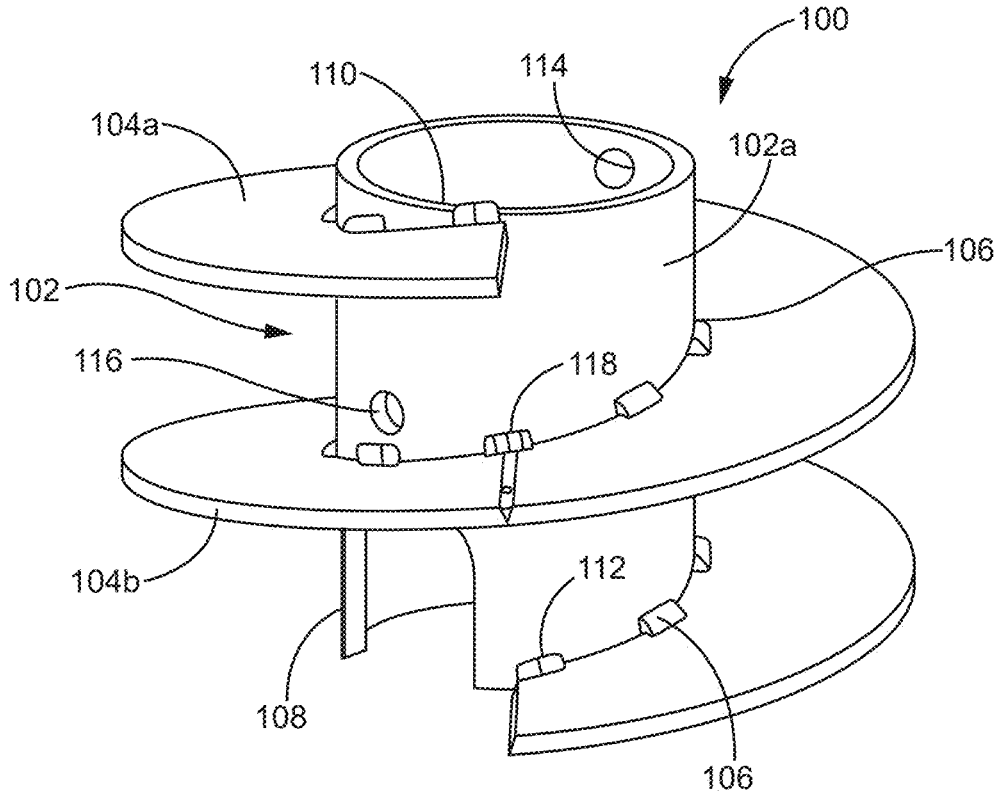
FIG. 11 is a perspective view of an auger subassembly in accordance with another embodiment of the present disclosure.
Figure 12:
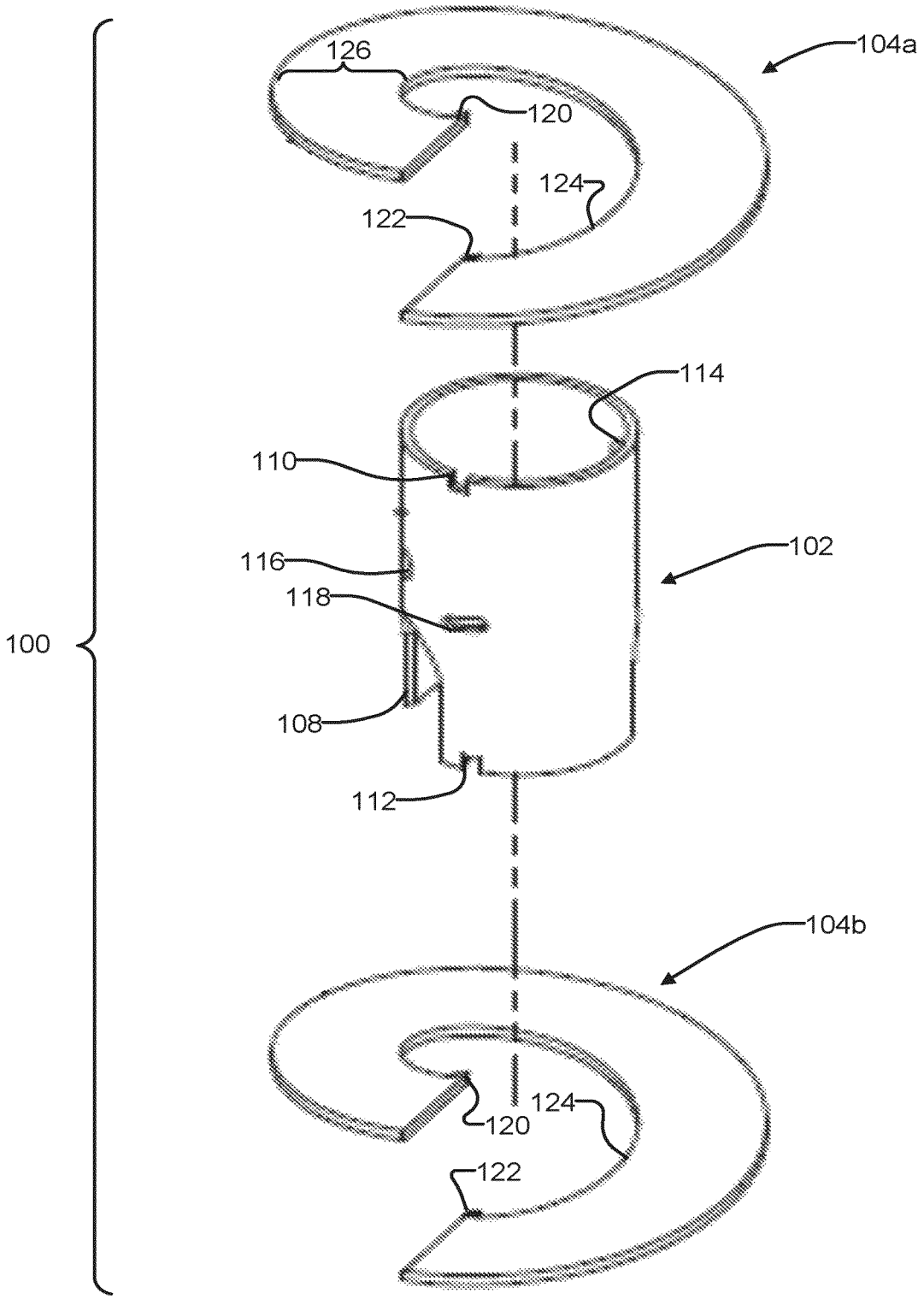
FIG. 12 is an exploded perspective view of the auger subassembly of FIG. 11.

Referring to FIGS. 11 and 12, there is shown another embodiment of the auger element which forms a complete auger subassembly 100 for use with the pump 10 of FIG. 1. The auger subassembly 100 may be installed concentrically over an existing fluid discharge tube, such as 28 shown in FIG. 11, as will be explained in greater detail in the following paragraphs. FIG. 12 shows the major components of the auger subassembly 100 separated from one another. The auger subassembly 100 may be constructed as a permanently attached portion of the discharge tube 28. Alternatively, the auger subassembly 100 may be formed as a fully separate subassembly, as shown in FIGS. 11 and 12, and secured by suitable threaded fasteners, as will be explained in greater detail in the following paragraphs. The auger could also be integrated in to the pump casing 12.

The auger subassembly 100 in this embodiment includes a barrel portion 102 around which are secured a pair of auger sections 104*a* and 104*b*. The auger sections 104*a* and 104*b*, often referred to as "flights" by those skilled in the art, form helical-like elements that may be permanently secured to an outer surface 102*a* of the barrel portion 102. In one implementation the auger sections 104*a* and 104*b* may be secured by spot welds 106, such that, in this embodiment, the entire auger subassembly 100 forms a single piece subassembly once fully constructed. Optionally, the auger sections 104*a* and 104*b* may be press fit onto the barrel portion 102. Other attachment implementations may also be used, as will be explained in the following paragraphs. Also, while two auger sections 104*a* and 104*b* are shown, it will be appreciated that the present disclosure may make use of one, three or greater number of auger sections. The present disclosure is therefore not limited to use with any particular number of auger sections In effect, the two auger sections 104*a* and 104*b* form a continuous helical-like auger element once secured to the barrel portion 102. And while spot welds are one suitable method for joining the auger sections 104*a* and 104*b* to the barrel portion 102, suitable adhesives may also be used for permanently securing the auger sections 104*a* and 104*b*. Still further, press-pins, interference fit geometry, or possibly even rivets could be used to secure the auger sections 104*a* and 104*b* to the barrel portion 102. If welding is used, V-groove or butt welds may be needed to secure the abutting ends of the auger sections 104*a* and 104*b*, possibly along with a small degree of surface grinding to leave a smooth continuous transition between the two auger sections. Honing of the interior of the barrel portion 102 may also be helpful after the welding has been performed to ensure diametric/cylindricity tolerances.

An internal diameter of the barrel section 102 is selected to be just slightly larger than the exterior diameter of the discharge tube 28 such that the barrel portion can be slid over the discharge tube during assembly of the pump 10, and further such that the barrel portion has minimal play once it is positioned over a portion of the discharge tube 28. The barrel portion 102 is preferably made from stainless steel or another suitable corrosion-resistant material, or possibly even high strength plastic. It is expected that stainless steel will be an especially preferred material in view of the harsh environment in which the pump 10 will be expected to operate in.

Figure 13:
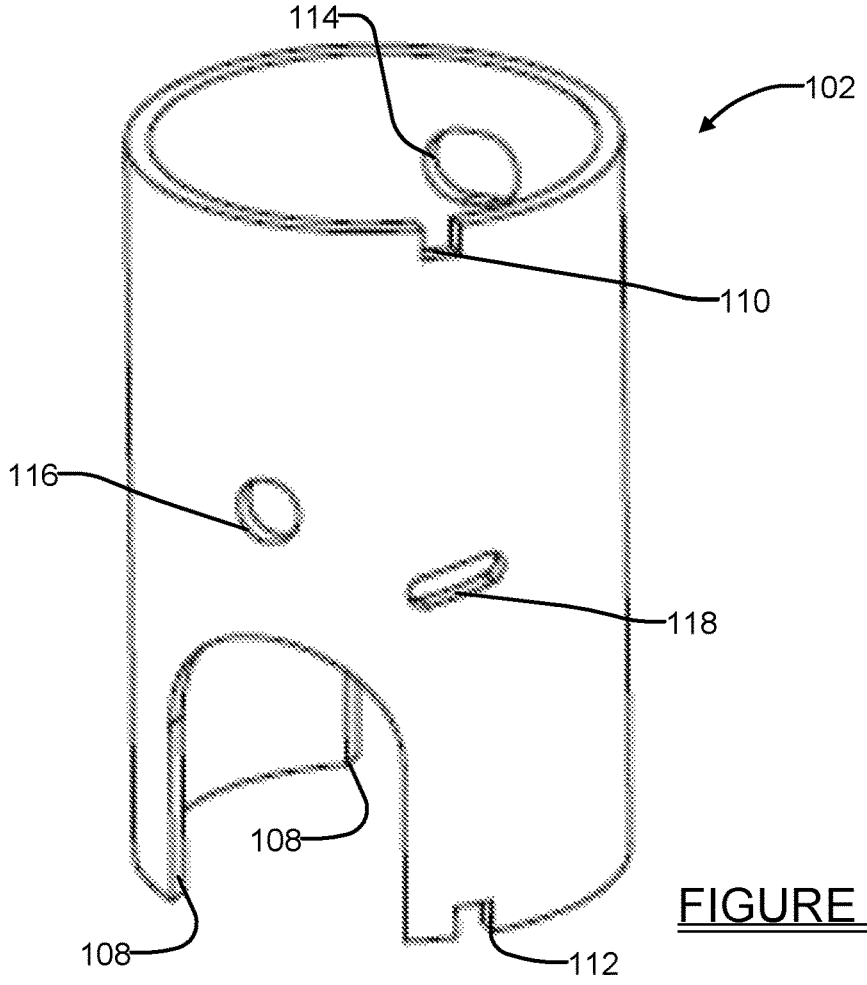
FIG. 13 is a perspective view of just the barrel portion of the auger subassembly.

Referring further to FIGS. 12 and 13, the barrel portion 102 can be seen in isolation. The barrel portion 102 includes a pair of generally U-shaped notch sections 108 arranged 180 degrees from one another, which keeps the openings 28*b* in the discharge tube 28 clear to allow fluid to be admitted into the discharge tube 28 during a fluid ejection cycle. Notches 110 and 112 at the upper and lower ends, respectively, of the barrel portion 102 help to facilitate alignment and attachment of the auger sections 104*a* and 104*b*. Threaded openings 114 and 116 may be used to receive threaded set screws (not shown), which enable the barrel section 102 to be releasably attached to the discharge tube 28 to permit easy removal for cleaning purposes. Elongated slot 118 helps to secure both a lower end of the upper auger section 104*a* and an upper end of the lower auger section 104*b*, as will be discussed momentarily.

Referring further to FIG. 12, each of the auger sections 104*a* and 104*b* include a first projecting tab 120 at a first inside edge of an upper end thereof, and a second projecting tab 122 at a second inside edge of a lower end thereof. The auger sections 104*a* and 104*b* may be made from stainless steel, high strength plastic, or any other suitably strong material that is preferably highly resistant to corrosive fluids and sludge. The sheet metal auger sections 104*a* and 104*b* permit a small degree of flexing thereof during their assembly onto the barrel portion 102. The inside edge 124 of each of the auger sections 104*a* and 104*b* forms an opening of a diameter which is just slightly larger than the outer diameter of the barrel portion 102. In this example the auger sections 104*a* and 104*b* are identical in construction (i.e., identical in dimensions, thickness, shape and material), although they need not necessarily be identical in construction.

Figure 14:
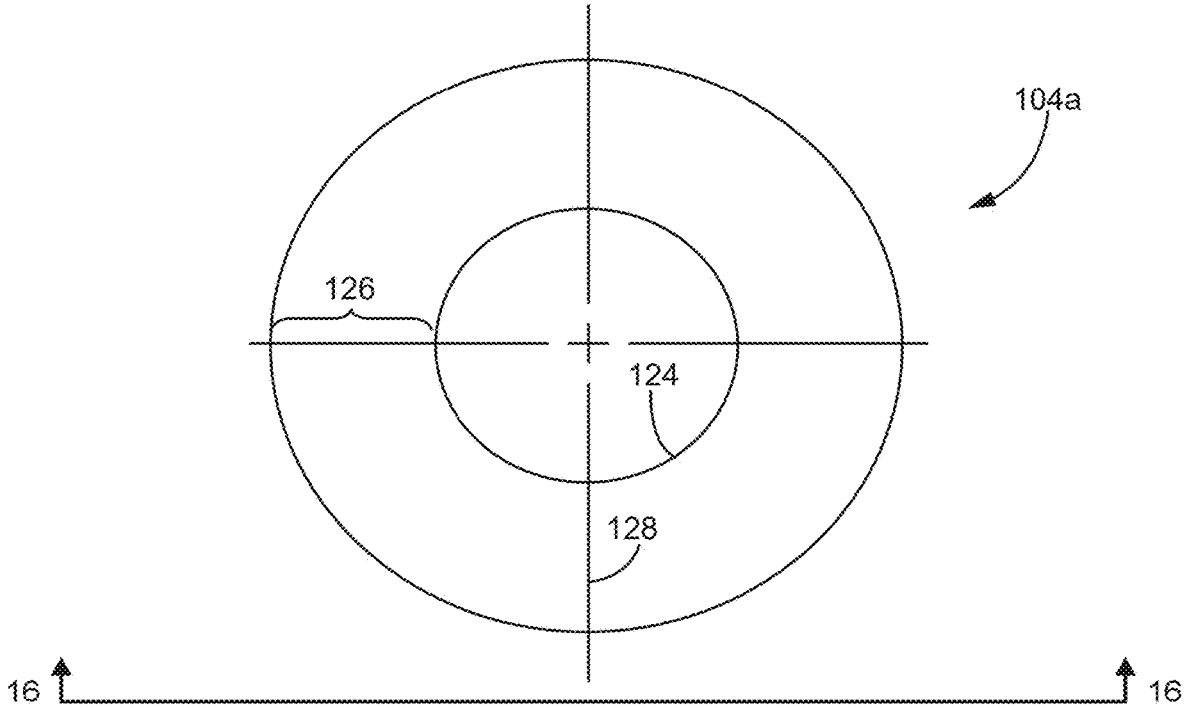
FIG. 14 is a plain view of one of the auger sections after being formed.

As best seen in FIG. 14, the auger sections 104*a* and 104*b* each have a length section 126 which is selected so that the auger elements 104*a* and 104*b* will substantially fill the space (i.e., leaving a minimal clearance on the order of about a few thousands of an inch) between the outermost edge of the auger sections 104 inside the outer casing 12 of the pump 10 once the auger assembly 100 is fully assembled and installed in the pump. In other words, the outer diameter of each of the auger sections 104*a* and 104*b* is just slightly less than an inner diameter of the outer casing 12, which enables the auger sections 104*a* and 104*b*.

Figure 16:
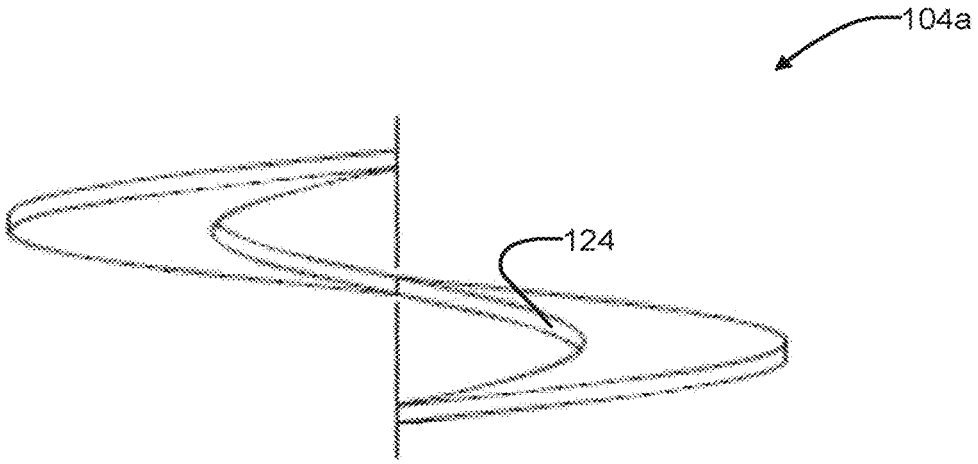

The auger section 104*a* is shown in FIG. 14 after being cut at line 128. The cut at line 128 helps to create the projecting tabs 120 and 122. FIG. 15 shows the auger section 104*a* from a plan view after additional material removal at the cut line. The auger section 104*a* is shown in FIG. 16 after being bent into its finished shape.

With further brief reference to FIG. 12, to assemble the auger subassembly 100 the upper auger section 104*a* may be first assembled onto the barrel portion 102. This involves flexing the auger section 104*a* to fit it over the upper end of the barrel portion 102 such that the projecting tabs 120 and 122 engage within the notch 110 and the slot 118, respectively. Then the lower auger section 104*b* may be slipped over the lower end of the barrel portion 102 such that its first projecting tab 120 also fits into the slot 118, and the second projecting tab 122 fits in the notch 112. At this point a plurality of the spot welds 106 (shown in FIG. 11) may be applied to permanently secure the auger sections 104*a* and 104*b* to the barrel portion 102. In this embodiment, then, the entire auger subassembly 100 may then be slipped over the discharge tube 28 and threaded set screws (not shown) used to secure the auger assembly at a desired axial location on the discharge tube which keeps the openings 28*b* clear for fluid flow into the discharge tube. As noted above, other attachment means such as a press fit pin, rivets, or mating geometry may be used to form the attachment. The auger subassembly 100 operates in the same manner as described above for the auger element 36.

Referring to FIG. 17, another implementation for securing the auger subassembly 100' to the fluid discharge tube is shown. This implementation provides the important advantage of quickly helping angulary align the barrel portion 102 with the openings 28*b* on the fluid discharge tube 28. To accomplish this an upper U-shaped notch 108*a* may be formed in the barrel portion 102. A locating tab 150 having a diameter just slightly smaller than the width of the upper U-shaped notch 108*a* may be fixedly secured to the fluid discharge tube 28 such as by welding, adhesives, a threaded screw, etc. The locating tab may be plastic, metal or made from any other suitable material, and preferably has a slight arc with a radius of curvature which generally conforms to the outer diameter of the barrel portion 102. In this manner, once attached to the fluid discharge tube 28, the locating tab 150 will sit flush over its full inside surface with the outer surface of the fluid discharge tube. The locating tab 150 is circumferentially positioned such that when the barrel portion 102 is slid onto the distal end of the discharge tube 28, the upper U-shaped notch 108*a* will engage with the locating tab 150 and position the lower notch 108 in alignment with the openings 28. To retain the auger subassembly 100' on the discharge tube a snap ring 152 may be used which engages with a channel (not visible) in the figure at the distal end of the discharge tube 28. However, any other suitable attachment method may be provided, such as a set screw, or a press fit pin or other type of interference geometry coupling. Preferably, the method of attachment used will permit quick and easy removal of the auger subassembly 100' for cleaning or repair purposes. The use of the locating tab 150 in connection with the upper U-shaped notch 108*a* significantly enhances the speed and accuracy of assembly of the auger subassembly 100', and essentially ensures that the auger subassembly cannot be installed in a manner that would block the openings 28*b* in the fluid discharge tube 28.

Referring to FIGS. 18-20, various additional attachment methods are disclosed for securing the auger assembly 100 or 100' to the fluid discharge tube 28. Merely for convenience, the auger assembly 100 will be referenced in the following discussion of FIGS. 18-20.

FIG. 18 shows a threaded bolt 160 which may be inserted through aligned, opposing holes 162 in the barrel section 102, and also through aligned holes 166 in the barrel portion 102, and secured using a threaded nut 164. Optionally an elongated press fit pin may be used. The holes 162 and 164 are preferably arranged on such that once the threaded bolt (or elongated pin) is inserted, the barrel portion 102 will be correctly positioned on the discharge tube with the holes 28*b* clear.

FIG. 19 shows another attachment method that uses at least one rivet or short threaded bolt 170 which extend through the openings 162 and 166.

FIG. 20 shows still another attachment method where a threaded bolt 180 is positioned to extend through an opening in a flange 182, where the flange 182 is fixedly attached to the barrel portion 102 and extends out laterally from the barrel portion 102. The threaded bolt 180 in this example extends through a hole in the spider 24, through a tubular spacer 186, and into a threaded hole 184 in the frame member 25 associated with the spider. The tubular spacer 186 has a length selected so properly set the axial position of the auger subassembly 100 on the discharge tube 28. In this example the flange 182 is located on the barrel portion 102 such that the barrel portion, once attached to the spider 24, will be properly circumferentially aligned with the holes 28*b* in the fluid discharge tube 28. So the auger subassembly 100 is both axially and circumferentially aligned on the fluid discharge tube 28 using the flange 182 and threaded bolt 180.

It will be appreciated that with the attachment implementations shown in FIGS. 18-20, the use of the snap ring 152, while shown in the figures, may not be needed to secure the auger subassembly 100 to the fluid discharge tube 28.

The auger subassembly 100 provides several important advantages, one of which is its ability to be quickly and easily removed from the discharge tube 28 for cleaning. No special tools beyond possibly a screw driver are needed for this task. If a portion of the auger subassembly 100 is discovered to be damaged (i.e., bent), the entire auger assembly 100 can be easily replaced without any modifications being required on the discharge tube 28 or any other portion of the pump 10. The construction of the auger subassembly 100 as a complete subassembly also potentially enables it to be retrofitted to existing pump structures with little or no modifications to the pump structure.

The use of two separate auger sections 104*a* and 104*b* further significantly eases fabrication of the auger sections from separate sections of metal, as well as easing assembly of the auger sections onto the barrel portion 102. The auger subassembly 100 also forms a relatively inexpensive portion of the overall pump 10, thus helping to maintain a highly economical pump construction, while still providing the benefits of creating a strong swirling fluid flow during every pump cycle of the pump, which helps significantly to maintain the interior of the pump clean and free from sludge and debris build up.

The self-cleaning operation provided by the auger element 36, as well as the auger subassembly 100, does not add significant complexity, cost or weight to the pump 10, nor does it significantly complicate assembly or disassembly of the pump 10. The auger element 36 or the auger subassembly 100 may also be retrofitted into existing pumps, with the only possible modification required possibly being the addition of structure at the spider assembly 24 or along the discharge tube 28 to hold the auger element or the auger subassembly in place once assembly is complete. In the unlikely event that the auger element 36 or the auger subassembly 100 should break, removal and replacement is easily accomplished once the discharge tube 28 is removed from the pump casing 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fluid pump comprising:

a pump casing;

a top cap securable to an upper end of the pump casing and having an air intake port and a fluid discharge port;

a fluid discharge tube extending to adjacent a lower end of the pump casing, the fluid discharge tube configured to receive fluid from within the pump casing through at least one opening disposed adjacent the lower end of the pump casing;

a first one-way check valve adjacent the lower end of the pump casing forming a one-way path to admit fluid into the pump casing at the lower end of the pump casing during a fill cycle of operation of the pump, and a second one-way check valve at the fluid discharge port to release fluid during a discharge cycle; and an auger element disposed inside the pump casing and extending at least partially around the fluid discharge tube such that the fluid discharge tube extends at least partially through the auger element, and the auger element disposed between an outer surface of the fluid discharge tube and an inside surface of the pump casing and wherein a portion of the auger element is disposed between the at least one opening and the first one-way check valve and another portion of the auger element is disposed between the at least one opening and the second one-way check valve, the auger element configured to cause a swirling, rotational fluid flow in a first direction about the fluid discharge tube during the discharge cycle, the discharge cycle occurring in response to a release of compressed air into the pump casing in which fluid having collected within the pump casing is forced by the release of compressed air downward within the pump casing and then into the at least one opening and up through the fluid discharge tube and out from the pump casing;

wherein the swirling, rotational fluid flow helps to clean one or both of the inside surface of the pump casing and the outer surface of the fluid discharge tube by placing contaminant particles on one or both of the inside surface and the outer surface into the swirling, rotational fluid flow.

2. The fluid pump of claim 1, wherein the auger element comprises a helical-like element having a continuous radial helical wall portion.

3. The fluid pump of claim 1, wherein the auger element comprises an auger subassembly configured to be slid over and secured to the fluid discharge tube or integrated with the pump casing.

4. The fluid pump of claim 3, wherein the auger subassembly comprises:

a barrel section configured to be slid over the fluid discharge tube; and at least one helical-like auger section secured to the barrel section.

5. The fluid pump of claim 1, wherein the auger element comprises a plurality of opposing ramp portions connected by opposing flat sections.

6. The fluid pump of claim 5, wherein the auger element includes an opening formed in one of the opposing flat sections to enable attachment via a fastening element to an interior portion of the fluid pump.

7. A fluid pump comprising:

a pump casing;

a top cap securable to an upper end of the pump casing and having an air intake port and a fluid discharge port;

a fluid discharge tube extending to adjacent a lower end of the pump casing;

a first one-way check valve adjacent the lower end of the pump, forming a one-way path to admit fluid into the pump casing during a fill cycle of operation of the pump and a second one-way check valve at the fluid discharge port to release fluid during a discharge cycle; and an auger element disposed inside the pump casing and extending at least partially around the fluid discharge tube such that the fluid discharge tube extends at least partially through the auger element, and the auger element disposed between an outer surface of the fluid discharge tube and an inside surface of the pump casing, the auger element configured to cause swirling, rotational fluid flow in a first direction about the fluid discharge tube during the discharge cycle, the discharge cycle occurring in response to a release of compressed air into the pump casing in which fluid having collected within the pump casing is forced by the release of compressed air downward within the pump casing and then into and up through the discharge tube and out from the pump casing;

wherein the swirling, rotational fluid flow helps to clean one or both of the inside surface of the pump casing and the outer surface of the fluid discharge tube;

wherein the auger element comprises an auger subassembly configured to be slid over and secured to the fluid discharge tube or integrated with the pump casing; and wherein the auger subassembly comprises a barrel section configured to be slid over the fluid discharge tube, and a pair of helical-like auger sections secured to the barrel portion to form a single, continuous, helical auger portion.

8. The fluid pump of claim 7, wherein:

the barrel portion includes first and second notches at opposing ends, and a slot at an intermediate point along its length; and each of the pair of auger sections includes a pair of projecting tabs at opposing ends, select ones of the projecting tabs being secured to select ones of the first and second notches and to the slot, to connect the auger sections onto the barrel portion.

9. The fluid pump of claim 8, wherein the barrel portion includes at least one U-shaped notch, and wherein the fluid discharge tube includes at least one fluid inlet, the U-shaped notch being shaped to prevent covering the fluid inlet on the fluid discharge tube.

10. A fluid pump comprising:

a pump casing;

a top cap securable to an upper end of the pump casing and having an air intake port and a fluid discharge port;

a fluid discharge tube extending to adjacent a lower end of the pump casing;

a one-way check valve adjacent the lower end of the pump, forming a one-way path to admit fluid into the pump casing during a fill cycle of operation of the pump and a one-way check valve at the pump's discharge port to release fluid during a discharge cycle; and an auger element disposed inside the pump casing for causing a swirling, rotational fluid flow during a fluid eject cycle, in response to a jet of compressed air released into the pump casing, in which fluid having collected within the pump casing is forced by the jet of compressed air into and up through the discharge tube, and out from the pump casing;

wherein the auger element includes a notch at one end; and wherein the fluid discharge tube includes a fixedly disposed locating component on an outer surface of the fluid discharge tube, for engaging with the notch when the auger element is positioned on the fluid discharge tube, to circumferentially align the auger element in a predetermined angular position on the discharge tube.

11. The fluid pump of claim 10, wherein the locating component also serves to position the auger element at a predetermined position along an axial length of the fluid discharge tube.

12. The fluid pump of claim 10, further comprising a removable retaining component for removably securing the auger element to the fluid discharge tube.

13. A fluid pump comprising: a pump casing; a top cap securable to an upper end of the pump casing and having an air intake port and a fluid discharge port; a fluid discharge tube extending to adjacent a lower end of the pump casing; a first one-way check valve adjacent the lower end of the pump, forming a one-way path to admit fluid into the pump casing during a fill cycle of operation of the pump and a second one-way check valve at the fluid discharge port to release fluid during a discharge cycle; and an auger element disposed inside the pump casing and extending at least partially around the fluid discharge tube such that the fluid discharge tube extends at least partially through the auger element, and the auger element disposed between an outer surface of the fluid discharge tube and an inside surface of the pump casing, the auger element configured to cause swirling, rotational fluid flow in a first direction about the fluid discharge tube during the discharge cycle, the discharge cycle occurring in response to a release of compressed air into the pump casing in which fluid having collected within the pump casing is forced by the release of compressed air downward within the pump casing and then into and up through the discharge tube and out from the pump casing; wherein the swirling, rotational fluid flow helps to clean one or both of the inside surface of the pump casing and the outer surface of the fluid discharge tube; and wherein the auger element is positioned against a wall structure of the first one-way check valve, and causes a rotational swirling flow during a fluid fill cycle of the pump which is opposite to the swirling rotational flow caused during the discharge cycle; and wherein the auger element forms a single piece component having an upper portion, a mid-portion and a lower portion.

14. The fluid pump of claim 13, wherein:

the upper portion includes an upper radial wall section;

the mid portion includes a mid-radial wall section;

the lower section includes a lower radial wall section; and the upper radial wall section has a wider width than the lower radial wall section.

15. A fluid pump comprising:

a pump outer casing;

a top cap securable to an upper end of the pump outer casing and having an air intake port and a fluid discharge port, the air intake port configured for admitting a jet of pressurized air into the pump outer casing to initiate a fluid discharge cycle of operation of the pump;

a fluid discharge tube extending along an axis and to a point adjacent a lower end of the pump outer casing, the fluid discharge tube configured to receive fluid from within the pump outer casing through an intake port at a lower end of the fluid discharge tube disposed adjacent the lower end of the pump outer casing;

a first one-way check valve disposed in the pump outer casing adjacent the lower end of the pump outer casing, the first one-way check valve forming a one-way path to admit fluid into the pump outer casing at the lower end of the pump outer casing during a fill cycle of operation of the pump, the first one-way check valve closed during the fluid discharge cycle of operation of the pump to prevent retrograde flow through the one-way path; and an auger subassembly disposed inside the pump outer casing and wrapped at least partially around the lower end of the fluid discharge tube, the auger subassembly disposed at least partially axially between the intake port through which the fluid enters into the fluid discharge tube and a second one-way check valve through which the fluid exits from the fluid pump and the auger subassembly disposed at least partially axially between the intake port and the lower end of the pump outer casing, the auger subassembly configured to cause a first swirling, rotational fluid flow during the fluid discharge cycle of operation of the pump, in response to the jet of pressurized air released into the pump outer casing, in which fluid having collected within the pump outer casing is forced by the jet of pressurized air down within the pump outer casing and past the auger subassembly such that the auger subassembly causes the first swirling, rotational fluid flow and in which the fluid is then forced into the discharge tube through the intake port and then is forced up through the discharge tube, and out from the pump outer casing and through the second one-way check valve;

wherein the first swirling, rotational fluid flow helps to clean one or both of an inside surface of the pump outer casing and an outer surface of the fluid discharge tube by removing contaminant particles on one or both of the inside surface and the outer surface to place the contaminant particles in the first swirling, rotational fluid flow.

16. The fluid pump of claim 15, wherein the auger subassembly is configured to generate a second swirling, rotational fluid flow during a fluid fill cycle of operation of the pump, the second swirling, rotational flow moving in a direction opposite to the first swirling, rotational fluid flow.

17. The fluid pump of claim 15, wherein the first one-way check valve includes a spider assembly and a poppet element captured within the spider assembly.

18. The fluid pump of claim 15, wherein an outer diameter of the auger subassembly extends to substantially reach to an inside wall surface of the pump outer casing.

19. A fluid pump comprising:

a pump outer casing;

a top cap securable to an upper end of the pump outer casing and having an air intake port and a fluid discharge port, the air intake port configured for admitting a jet of pressurized air into the pump outer casing to initiate a fluid discharge cycle of operation of the pump;

a fluid discharge tube extending to a point adjacent a lower end of the pump outer casing;

a first one-way check valve disposed in the pump outer casing adjacent the lower end of the pump, the first one-way check valve forming a one-way path to admit fluid into the pump outer casing during a fill cycle of operation of the pump, the first one-way check valve closed during a discharge cycle of operation of the pump to prevent retrograde flow through the one-way path; and an auger subassembly disposed inside the pump outer casing and wrapped at least partially around the fluid discharge tube, the auger subassembly disposed at least partially between an intake port of the fluid discharge tube through which the fluid enters into the fluid discharge tube and a second one-way check valve, the auger assembly configured to cause a first swirling, rotational fluid flow during a fluid eject cycle of operation of the pump, in response to the jet of pressurized air released into the pump outer casing, in which fluid having collected within the pump outer casing is forced by the jet of pressurized air down within the pump outer casing and past the auger subassembly such that the auger subassembly causes the swirling, rotational fluid flow and in which the fluid is then forced into the discharge tube through the intake port and then is forced up through the discharge tube, and out from the pump outer casing and through the second one-way check valve;

wherein the auger subassembly includes:

a barrel portion configured to be slid over the fluid discharge tube; and at least one auger section secured to the barrel portion; and wherein the at least one auger section includes a pair of auger sections secured to the barrel portion to form a single helical-like auger element.

20. A method for pumping fluid using a pneumatically operated fluid pump, the method comprising:

admitting fluid into a pump outer casing through an open one-way check valve located at a lower end of the pump outer casing with a closed check valve at a fluid discharge port, the pump having a top cap securable to an upper end of the pump outer casing, the top cap having an air intake port and the fluid discharge port, and the pump having a fluid discharge tube extending to adjacent the lower end of the pump outer casing, the fluid discharge tube receiving the fluid from within the pump casing at a lower end of the fluid discharge tube, and an auger element wrapped at least partially around the lower end of the fluid discharge tube such that the fluid discharge tube extends at least partially through the auger element and such that an intake port through which the fluid discharge tube receives the fluid from within the pump casing is disposed at a location between an upper end of the auger element and a lower end of the auger element;

when the pump outer casing is full with fluid, admitting pressurized air into the pump outer casing;

using the pressurized air to cause the one-way check valve to close the lower end of the pump outer casing; and using the pressurized air in connection with the auger element to cause a swirling, rotational fluid flow between an outer surface of the fluid discharge tube and an inside surface of the pump outer casing as the fluid within the pump outer casing is forced down past the auger element and then into the fluid discharge tube and then up through the fluid discharge tube; and helping to clean, by the swirling, rotational fluid flow, one or both of the inside surface of the pump casing and the outer surface of the fluid discharge tube by removing contaminant particles on one or both of the inside surface and the outer surface into the swirling, rotational fluid flow.

* * * * *